United States Patent [19]

Watanabe

[11] Patent Number: 4,934,002

[45] Date of Patent: Jun. 19, 1990

[54] TILTABLE MAT ASSEMBLY

[75] Inventor: Yasuo Watanabe, Komae, Japan

[73] Assignee: Kabushiki Kaisha Nihon M.D.M., Tokyo, Japan

[21] Appl. No.: 368,632

[22] Filed: Jun. 20, 1989

[51] Int. Cl.[5] ..... A61G 7/00; A47C 27/10

[52] U.S. Cl. ..... 5/61; 5/425; 5/453; 5/457

[58] Field of Search ..... 5/455, 61, 60, 453, 5/424, 425, 449, 457

[56] References Cited

U.S. PATENT DOCUMENTS

| | | | |
|---|---|---|---|
| 3,717,885 | 2/1973 | De Mare | 5/61 |
| 3,978,530 | 9/1976 | Amarantos | 5/68 |
| 4,234,982 | 11/1980 | Bez et al. | 5/455 |
| 4,441,220 | 4/1984 | Peterson | 5/61 |
| 4,527,298 | 7/1985 | Moulton | 5/455 |
| 4,654,903 | 4/1987 | Chubb et al. | 5/61 |
| 4,697,290 | 10/1987 | Alkind et al. | 5/61 |
| 4,826,247 | 5/1989 | McGrady et al. | 5/61 |
| 4,839,932 | 6/1989 | Williamson | 5/453 |

FOREIGN PATENT DOCUMENTS

| | | | |
|---|---|---|---|
| 841703 | 5/1959 | France | 5/455 |

*Primary Examiner*—Alexander Grosz

*Attorney, Agent, or Firm*—Schwartz & Weinrieb

[57] ABSTRACT

A mat assembly is constructed so as to be tilted about a longitudinal axis by means of a pair of inflatable air bags. The mat assembly has an upper air cushion sheet mounted upon a frame, a lower air cushion sheet provided upon the underside of the frame, and a pair of air bags disposed upon the underside of the lower air cushion sheet at right and left thereof as viewed in the longitudinal direction. By supplying air to a bag upon one side and by discharging air from the bag upon the other side, the mat assembly is tilted.

11 Claims, 4 Drawing Sheets

TILTABLE MAT ASSEMBLY

FIELD OF THE INVENTION

The present invention relates to a mat assembly to be mounted upon a bed frame and which is capable of being tilted about a longitudinal axis thereof, and more particularly to a tiltable mat assembly for a patient which can be tilted or turned about a longitudinal axis thereof for assisting the patient to turn in bed and/or for preventing the patient from developing bed sores.

BACKGROUND OF THE INVENTION

In order to change the inclination of a mat disposed upon a bed, a tiltable mat supporting device has been used, in which a supporting member for the mat is rotatably mounted upon a longitudinal shaft provided upon the bed frame. The supporting member is mechanically turned upon the shaft or is turned by inserting an airbag having a triangularly-shaped section between the mat and the bed frame.

The former system is provided with a large-scale driving device for inclining the mat supporting member. Furthermore, it is necessary to provide a safety device such as a stopper for the rotation of the mat supporting member at a predetermined position. Therefore, the system is complicated in construction which causes an increase in the manufacturing cost thereof. In this system, when the mat is inclined at a relatively large angle, the mat may also slip off the airbag or the patient disposed within the bed may fall off the mat.

OBJECT OF THE INVENTION

The object of the present invention is to provide a tiltable mat assembly which has a simple construction and which can safely help a patient to turn in bed.

SUMMARY OF THE INVENTION

According to the present invention, there is provided a mat assembly comprising a rectangular frame made of an airtight bag including a plurality of porous particles disposed therein and having fences along the longitudinal sides thereof, and a valve for maintaining the bag in a vacuum state, an upper air cushion sheet having a plurality of longitudinal partitions defined therein and mounted upon the frame for covering the frame, a lower air cushion sheet having a plurality of lateral partitions defined therein and provided upon the underside of the frame, and a pair of air bags disposed upon the underside of the lower air cushion sheet along at right and left sides thereof as viewed in the longitudinal direction, each of the air bags having a valve for supplying air to the bag and for discharging air from the bag.

The present invention further provides a mat assembly comprising a rectangular frame made from an airtight bag including a plurality of porous disposed particles therein and having fences extending along both longitudinal sides thereof, both sides and a valve for maintaining the bag in a vaccum state, an upper air cushion sheet having a plurality of longitudinal partitions defined therein and mounted upon the frame for covering the frame, a lower air cushion sheet having a plurality of lateral partitions defined therein and provided upon the underside of the frame, a pair of air bags disposed upon the underside of the lower air cushion sheet along right and left sides thereof as viewed in the longitudinal direction, each of the air bags having a valve for supplying air to the bag and for discharging air from the bag, a connecting sheet disposed upon the underside of the frame and detachably connected to the upper air cushion sheet at both sides thereof, and a pocket formed upon the connecting sheet, the lower air cushion sheet being disposed within the pocket.

In accordance with one aspect of the invention, the air bag of each side comprises a plurality of superimposed bags, the uppermost bag is connected to the connecting sheet at the outer side thereof, and the right side bag and left side bag are connected to each other at a central portion therebetween.

BRIEF DESCRIPTION OF THE DRAWINGS

Other objects and features of the present invention will become more apparent from the following detailed description with reference to the accompanying drawings, wherein.

DETAILED DESCRIPTION OF THE PREFERRED EMBODIEMENT

Figure 1:
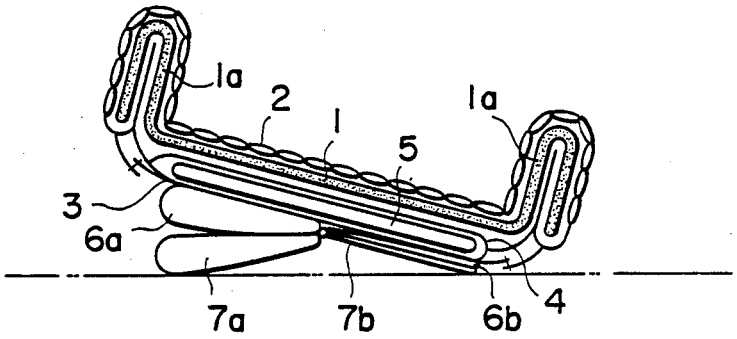
FIG. 1 is a sectional view showing a tiltable mat assembly according to the present invention.
Figure 2:
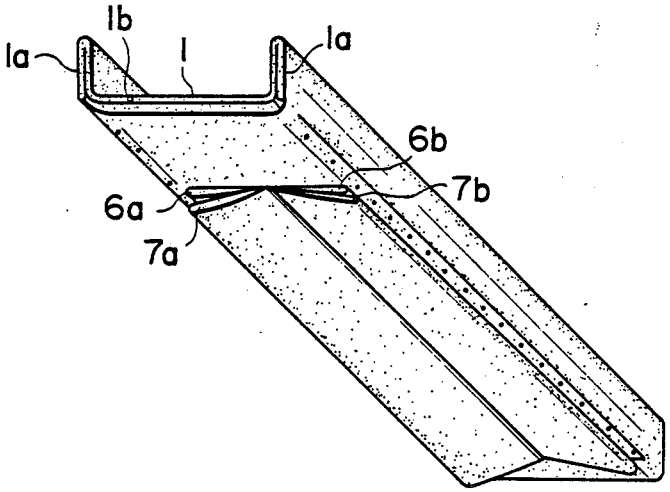
FIG. 2 is a perspective view of the mat assembly as viewed from the underside of the mat assembly.
Figure 3:
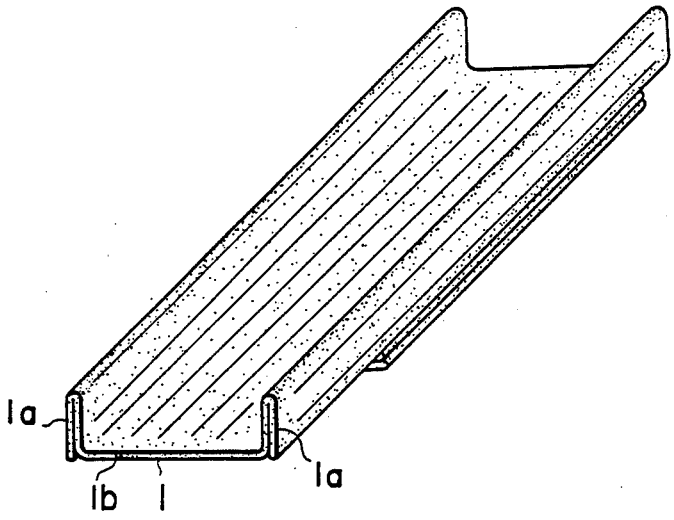
FIG. 3 is a perspective view of the mat frame.

Referring to FIGS. 1 to 3, a rectangular frame 1 in the form of an airtight bag made from a nonwoven fabric includes a large number of porous particles therein. As shown in FIG. 3, both of the longitudinal sides of the frame 1 are bent upwardly so as to form side fences 1*a*. A valve 1*b* for the discharge of air is provided. By exhausting air with a vacuum pump, the frame 1 is stiffened with the particles and the fabric tightly compacted.

Figure 6:
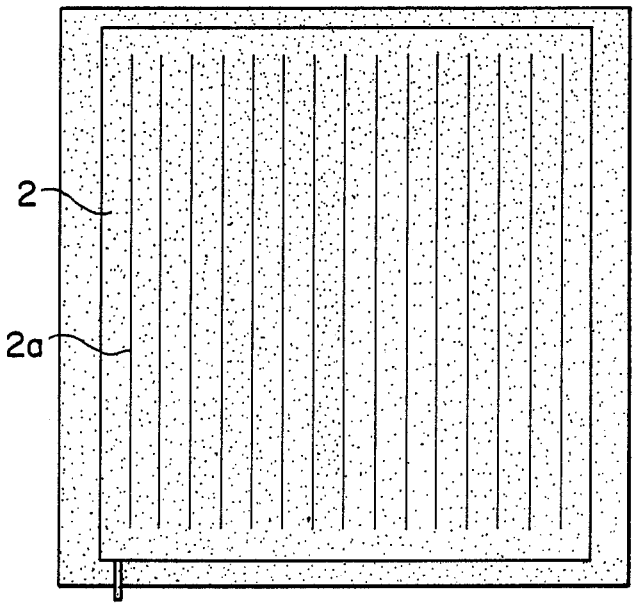
FIG. 6 is a plan view of the upper air cushion sheet.

An upper air cushion sheet 2 is attached to the frame 1 so as to cover the frame 1 as shown in FIG. 1. Referring to FIG. 6, the upper air cushion sheet 2 has a plurality of partitions 2*a* formed along the logitudinal direction of the sheet 2, thereby increasing the longitudinal rigidity of the upper air cushion sheet 2.

Figure 4:
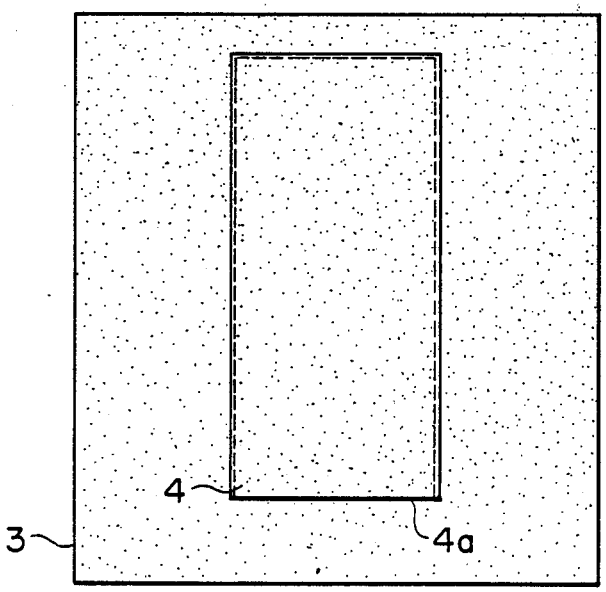
FIG. 4 is a plan view of the mat connecting sheet.
Figure 5:
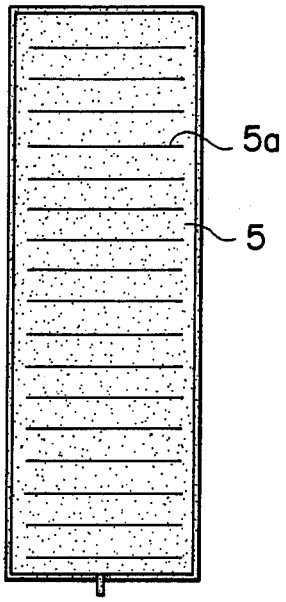
FIG. 5 is a plan view of the lower air cushion sheet.

A connecting sheet 3 is attached to the underside of the frame 1 in such a manner that longitudinally edges of both sides of the connecting sheet 3 are detachably attached to both sides of the upper air cushion sheet 2 by tying connecting strings. Referring to FIG. 4, the connecting sheet 3 has a pocket 4 within which a lower air cushion sheet 5 is inserted. As shown in FIG. 5, the lower air cushion sheet 5 has a plurality of partitions 5*a* extending in the lateral direction of the sheet 5 so that the lateral rigidity thereof is increased.

Figure 7:
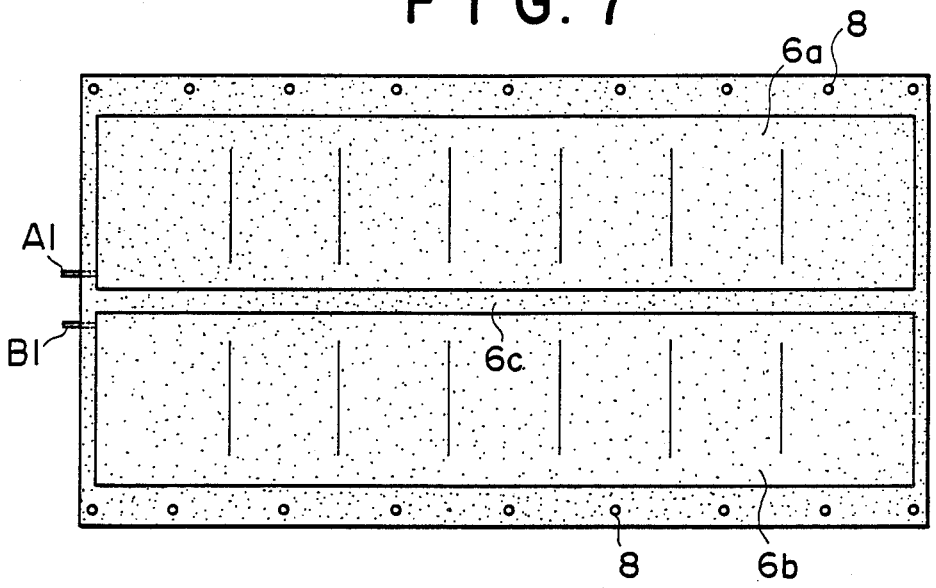
FIG. 7 is a plan view of the upper air bags.
Figure 8:
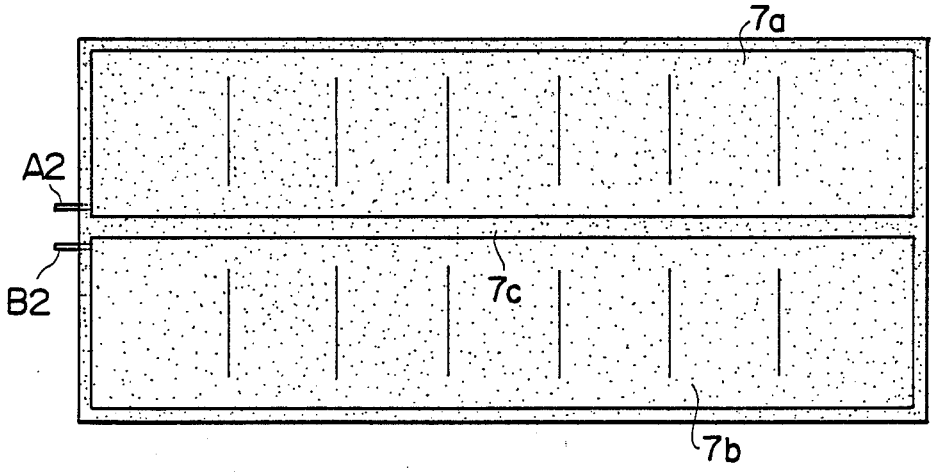
FIG. 8 is a plan view of the lower air bags.
Figure 9:
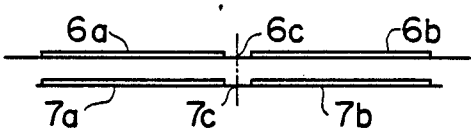
FIG. 9 is a sectional view showing the assembly of the upper and lower air bags.

To the underside of the connecting sheet 3, inflatable air bags 6*a*, 6*b*, 7*a* and 7*b* are attached upon the right side and left side thereof as viewed in the longitudinal direction thereof. Air bags 6*a* and 7*a* and air bags 6*b* and 7*b* upon both sides of the assembly are superimposed with respect to each other, respectively. Referring to FIGS. 7 and 8, the inflatable air bags 6*a*, 6*b*, 7*a* and 7*b* are provided with air charge/discharge valves A1, B1, A2 and B2, respectively. Right and left air bags 6*a* and 6*b* comprise a series of air chambers and are connected to each other by means of a central portion 6c. A plurality of buttons 8 are provided along both longitudinal sides of the air bags so as to be attached to the connecting sheet 3. Referring to FIG. 8, each of the air bags 7a and 7b comprises a series of air chambers. A central portion 7c is provided for connecting the air bags 7a and 7b to each other.

When assembling the mat of the present invention, the air bags 6a and 6b are superimposed upon the air bags 7a and 7b and the central portions 6c and 7c are connected together by means of a sewing operation. The upper air bags 6a and 6b are attached to the connecting sheet 3 by means of the buttons 8 provided upon the sides of the air bags 6a and 6b.

When using the mat assembly, the frame 1 is covered by means of the upper air cushion sheet 2 and the mat assembly is secured to a bed frame. A mattress is placed upon the upper air cushion sheet 2 and a patient is laid upon the mattress.

Since the upper air cushion sheet 2 has a plurality of longitudinal partitions 2a so as to increase the longitudinal rigidity thereof and the lower air cushion sheet 5 disposed beneath the frame 1 has a plurality of lateral partitions 5a so as to increase the lateral rigidity thereof, rigidity of the frame 1 is reinforced.

The amount of air within the air chambers of the air bags 6a, 6b, 7a and 7b is selectively varied. For example, by continuously supplying the air to the bags of one side and by discharging the air within the bags of the other side through means of valves A1, A2 and B1, B2, and vice versa, the inclination of the surface of the mat assembly is changed. Thus, the mat assembly is tilted or rolled so as to help the patient to turn in bed. The inclination may also be changed by varying the amount of air within the bags of one side only.

Since the lower air cushion sheet 5 disposed within the connecting sheet 3 has a sufficient thickness, both lower side portions of the mat assembly are prevented from touching the bed frame. Furthermore, the fences 1a of the frame 1 prevent the patient from falling off the mattress.

Both sides of the connecting sheet 3 are detachably attached to both sides of the upper air cushion sheet 2, the lower air cushion sheet 5 is disposed within the pocket 4 provided upon the connecting sheet 3, and only upper air bags 6a and 6b are attached to the connecting sheet 3 at both sides thereof and upper air bags 6a and 6b are integrally connected to lower air bags 7a and 7b at the central portion thereof. Accordingly, the mat assembly can be inclined without interference between the members. Furthermore, assembling and disassembling of the mat assembly can be easily preformed.

In accordance with the present invention, the following effects and advantages can be obtained:

(1) The upper air cushion sheet has a plurality of longitudinal partitions defined therein so as to increase the longitudinal rigidity thereof and the lower air cushion sheet disposed beneath the frame has a plurality of lateral partitions defined therein so as to increase the lateral rigidity thereof. Thus, such structures are effective to reinforce the frame.

(2) The amount of air within the air chambers of the air bags is selectively varied by supplying air to the air bags of one side and by discharging air within the air bags of the other side. Accordingly, the mat assembly is inclined or rolled so as to help the patient to turn in bed.

The lower air cushion sheet provided within the connecting sheet has a predetermined thickness. Accordingly, both of the lower side portions of the mat assembly are prevented from touching the floor or bed frame.

(3) Since the fences are provided upon the mat assembly, a patient laid upon the mattress is prevented from falling off the mattress.

(4) Both sides of the connecting sheet are detachably attached to both sides of the upper air cushion sheet and the lower air cushion sheet is inserted within the pocket provided upon the connecting sheet. Thus, assembling and disassembling of the mat assembly can be easily performed.

While the invention has been described in conjunction with a preferred specific embodiment thereof, it will be understood that this description is intended to illustrate and not limit the scope of the invention, which is defined by the following claims.

What is claimed is:

1. A mat assembly, comprising:

a rectangular frame made from an airtight bag including a plurality of porous particles disposed therein, fences extending along both longitudinal sides thereof, and a valve for maintaining said bag in a vacuum state;

an upper air cushion sheet having a plurality of longitudinal partitions and mounted upon said rectangular frame for covering said frame;

a lower air cushion sheet having a plurality of lateral partitions defined therein and provided upon an underside portion of said frame;

a pair of air bags disposed upon an underside portion of said lower air cushion sheet along right and left side portions thereof as viewed in the longitudinal direction; and valve means operatively connected to said air bags for supplying air to said air bags and for discharging air from said air bags.

2. The mat assembly according to claim 1, further comprising:

a connecting sheet disposed upon said underside portion of said frame and detachably connected to said upper air cushion sheet along both sides thereof; and a pocket formed within said connecting sheet with said lower air cushion sheet being disposed within said pocket.

3. The mat assembly according to claim 2, wherein:

said air bag of each side comprises a plurality of superimposed bags, the uppermost bags being connected to said connecting sheet at outer side portions thereof; and wherein further, said right side bag and said left side bag are connected to each other at a central portion thereof.

4. A mat assembly, comprising:

a substantially rectangular frame member;

vertically upstanding fence means, integrally formed with said frame member and disposed along opposite side edge portions of said substantially rectangular frame member such that a cross-sectional configuration of the resulting integral structure has a substantially U-shaped configuration, for defining with said frame member a space for accommodating a person;

an upper air cushion sheet, provided with longitudinally extending partitions for increasing the longitudinal rigidity thereof, disposed atop said frame member for supporting said person;

a pair of air bags disposed beneath said frame member along opposite side partions thereof;

means interconnecting said pair of air bags to said upper air cushion sheet such that said upper air cushion sheet, said interconnecting means, and said pair of air bags envelop said integral structure comprising said frame member and said fence means; and valve means operatively connected to said air bags for selectively supplying air to said air bags and for selectively discharging air from said air bags so as to selectively inflate or deflate said air bags whereby said frame member, and said upper air cushion sheet disposed thereon, can be tilted about a longitudinal axis of said frame member so as to alter the position of said person supported upon said upper air cushion sheet and said frame member.

5. A mat assembly as set forth in claim 4, further comprising:

a lower air cushion sheet disposed beneath said frame member.

6. A mat assembly as set forth in claim 5, wherein:

said lower air cushion sheet is provided with laterally extending partitions for increasing the lateral rigidity thereof.

7. A mat assembly as set forth in claim 5, wherein:

said interconneting means comprises a connecting sheet disposed along an underside portion of said frame member, and string means disposed along opposite sides of said connecting sheet for detachably securing said connecting sheet to said upper air cushion sheet.

8. A mat assembly as set forth in claim 7, wherein: p1 said connecting sheet is provided with pocket means for housing said lower air cushion sheet.

9. A mat assembly as set forth in claim 4, further comprising:

a second pair of air bags disposed beneath said frame member such that a pair of said air bags is disposed upon each side of a longitudinal central axis of said frame member.

10. A mat assembly as set forth in claim 9, wherein:

each pair of said air bags disposed upon opposite sides of said longitudinal central axis of said frame member comprises a pair of substantially vertically stacked air bags.

11. A mat assembly as set forth in claim 4, wherein:

said pair of air bags are disposed upon opposite sides of a longitudinal central axis of said frame member; and said pair of air bgas are fluidically connected to each other by means of an interconnecting portion disposed along said longitudinal central axis of said frame member.

* * * * *